US005922362A

United States Patent [19]

Schippers et al.

[11] Patent Number: 5,922,362

[45] Date of Patent: Jul. 13, 1999

[54] SPIN BEAM FOR SPINNING A PLURALITY OF SYNTHETIC FILAMENT YARNS AND SPINNING MACHINE COMPRISING SUCH A SPIN BEAM

[75] Inventors: Heinz Schippers; Klaus Schafer, both of Remscheid, Germany

[73] Assignee: Barmag AG, Remscheid, Germany

[21] Appl. No.: 08/687,396

[22] PCT Filed: Dec. 1, 1995

[86] PCT No.: PCT/DE95/01705

§ 371 Date: Nov. 20, 1996

§ 102(e) Date: Nov. 20, 1996

[87] PCT Pub. No.: WO96/17116

PCT Pub. Date: Jun. 6, 1996

Related U.S. Application Data

[30] Foreign Application Priority Data

Dec. 2, 1994 [DE] Germany ..... 44 42 946
Dec. 22, 1994 [DE] Germany ..... 44 45 837

[51] Int. Cl.[6] ..... D01D 4/06; D01D 5/092

[52] U.S. Cl. ..... 425/72.2; 425/378.2; 425/382.2; 425/463; 425/464

[58] Field of Search ..... 425/72.2, 192 S, 425/378.2, 464, 131.5, 382.2, 463; 214/176.1; 264/211.14

[56] References Cited

U.S. PATENT DOCUMENTS

| | | | |
|---|---|---|---|
| 3,336,634 | 8/1967 | Brownley et al. | 425/72.2 |
| 3,381,336 | 5/1968 | Wells | 425/378.2 |
| 3,767,347 | 10/1973 | Landoni | 425/192 |
| 3,999,909 | 12/1976 | Schippers . | |
| 3,999,910 | 12/1976 | Pendlebury et al. . | |
| 4,035,127 | 7/1977 | Ogasawara et al. | 425/192 S |
| 4,469,499 | 9/1984 | Lecron et al. | 65/1 |
| 4,631,018 | 12/1986 | Valteris et al. | 425/445 |
| 4,698,008 | 10/1987 | Lenk et al. . | |
| 4,743,186 | 5/1988 | Schippers | 425/72.2 |
| 4,902,462 | 2/1990 | Bert | 264/211.14 |
| 5,059,104 | 10/1991 | Alberto | 425/72.2 |
| 5,145,689 | 9/1992 | Allen et al. | 425/469 |
| 5,700,491 | 12/1997 | Herwegh et al. | 425/72.2 |
| 5,733,586 | 3/1998 | Herwegh et al. | 425/382.2 |

FOREIGN PATENT DOCUMENTS

| | | | |
|---|---|---|---|
| 0 163 248 | 12/1985 | European Pat. Off. . | |
| 0 285 736 | 12/1988 | European Pat. Off. . | |
| 2 248 757 | 4/1974 | Germany . | |
| 24 38 364 | 8/1974 | Germany . | |
| 26 44 996 | 4/1977 | Germany . | |
| 33 43 714 | 6/1984 | Germany . | |
| 41 03 990 | 8/1991 | Germany . | |
| 195 13 941 | 10/1995 | Germany . | |
| 760329 | 10/1956 | United Kingdom | 425/382.2 |

*Primary Examiner*—Harold Y. Pyon
*Assistant Examiner*—Joseph Leyson
*Attorney, Agent, or Firm*—Alston & Bird LLP

[57] ABSTRACT

The invention relates to a spin beam (1) for spinning a plurality of synthetic filament yarns and a spinning machine comprising a spin beam (1) of this type. The spin beam (1) consists of an elongate rectangular solid, which is filled with a heating medium, and the underside of which mounts two parallel rows of connections (20), each connection accommodating a spin pot (17) with a spinneret (18). From a melt supply line (23), melt is distributed to a multiple spin pump (12) for each row of connections (20), and supplied therefrom via melt distribution lines (14) to the spin pots (17) of each row. The filaments emerging from spinnerets (18) are cooled and solidified below the spinnerets (18) by directing thereto a transverse flow of cooling air. The cooling air exits from a permeable wall (33) of an air distribution chamber, the permeable wall facing one row of spinnerets, and the chambers defining a common rectangular solid.

13 Claims, 2 Drawing Sheets

Fig. 2.
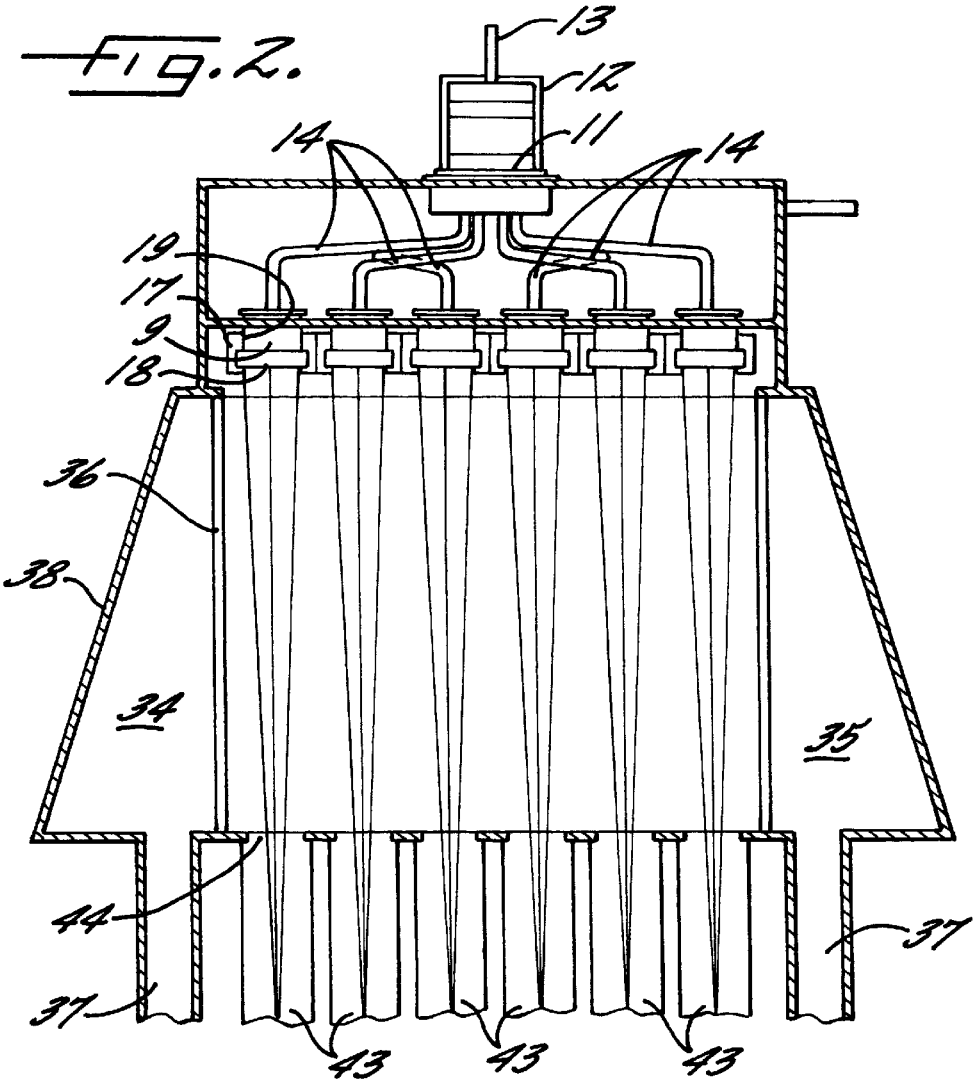
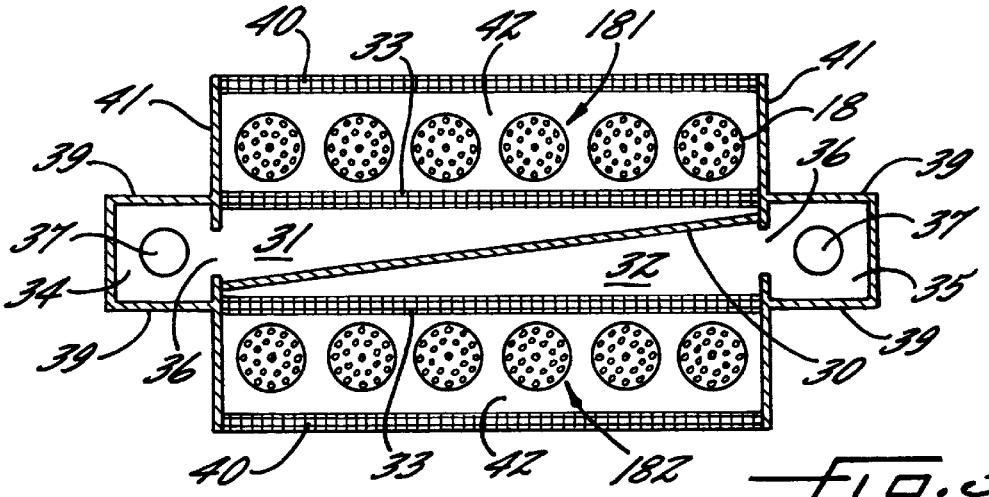
Fig. 3.

SPIN BEAM FOR SPINNING A PLURALITY OF SYNTHETIC FILAMENT YARNS AND SPINNING MACHINE COMPRISING SUCH A SPIN BEAM

BACKGROUND OF THE INVENTION

The invention relates to a spin beam for spinning a plurality of synthetic filament yarns and a spinning machine or spinning line comprising such a spin beam.

A spin beam for spinning a plurality of synthetic filament yarns, wherein the spinnerets are arranged in a row, is known from EP 163 248 B and corresponding U.S. Pat. No. 4,698,008. A spinning machine comprising a spin beam of this type is disclosed, for example, in DE-PS 24 38 364, DE-PS 41 03 990, or published Application DE 195 13 941 A1. The arrangement of the spinnerets in a row results in a great extension of the spinning machine in the longitudinal direction.

EP 0 285 736 discloses a spin beam which includes two parallel rows of spinnerets, and two parallel cooling chambers arranged below respective ones of the rows of spinnerets. With this apparatus, it is possible to spin a yet larger number of filament yarns in an arrangement that is as compact as possible and, in particular, to avoid irregular heat losses, which may lead to inhomogeneities in the yarns.

As a function of different process parameters in the melt spinning, it is yet impossible to obtain a homogeneous quality of the yarns from row to row despite a very compact construction of the spin beam. While these differences arising from the production of manufactured fibers may be compensated by a subsequent blending of the staple fibers to be spun, they are also noticeable in the winding of the filament yarns to packages and in the further processing thereof.

It is therefore the object of the invention to at least compensate for such differences in quality.

SUMMARY OF THE INVENTION

The above and other objects and advantages of the present invention are achieved by the provision of a spinning apparatus which comprises a spin beam in the form of an elongate rectangular enclosure which includes a top wall and a bottom wall, and with the bottom wall having a plurality of connections therein which extend along two parallel side by side rows. A spin pot is received in each of the connections, with each spin pot including a spinneret at the underside thereof, and a pair of pumps is mounted adjacent the top wall of the beam, with each of the pumps having multiple outlets. One of the pumps is located generally above one of the rows of connections, and the other of the pumps is located generally above the other of the rows. Also, a plurality of distribution lines extend from respective outlets of each of the pumps through the spin beam and to respective ones of the spin pots of its associated row of connections.

The spin beam of the present invention has the advantage that all spinnerets are accommodated in a single heating enclosure. The length of the heating enclosure is defined such that no temperature differences may result over its length, and that each row of spinnerets is associated to a multiple spin pump. This has also the special advantage of greater flexibility, since a breakdown of one of the pumps does not require a shutdown of the entire spinning machine.

The spinning machine of the present invention further comprises an air distribution enclosure positioned below the spin beam and between the rows of connections. The air distribution enclosure is of rectangular outline when viewed in horizontal cross section so as to define two outer side walls which extend parallel to the rows of connections and downwardly from the enclosure of the spin beam, with the outer side walls being air permeable so that cooling air introduced into the air distribution enclosure passes through the outer side walls and transversely across the filaments being extruded through the spinnerets. This construction permits the air distribution enclosure to be designed so narrow that it can be accommodated between two rows of closely arranged spinnerets. The air distribution enclosure may be divided by an internal partition to form two chambers which are separate from one another and supplied with air from two separate blowers. For a uniform cooling of all filaments emerging from the spinnerets of the rows of spinnerets, the vertical cross section of the air distribution chambers narrows in the direction of flow, so that the exit speed of the air flow through the air permeable walls in a direction toward the groups of filaments is substantially the same for all spinnerets of one row of spinnerets. An arrangement of two parallel rows of spinnerets is also of special advantage, when below and between these rows of spinnerets two identical air distribution chambers are provided back to back, which are separated from one another by a common partition wall.

In a spinning machine comprising two rows of spinnerets it is especially advantageous, when the air distribution chambers arranged below and between the rows of spinnerets are defined by an internal partition extending generally parallel to the two air permeable side walls as described above. This configuration is especially space saving, and it ensures a satisfactory heat balance and a satisfactory, uniform heat distribution by the cooling air emerging from the permeable walls over the entire length and width of the spinning machine. It should be noted that these air distribution chambers narrow in the direction of flow substantially in wedge-shape, so as to cause substantially equal amounts of cooling air to flow out and to prevent an irregular decrease of the air pressure in the direction of flow. The wedge-shaped configuration may also extend in particular over only a partial region of the air distribution chamber. Advantageously, such a narrowing of the air distribution chamber in direction of the rows of spinnerets may also be combined with a cross section of the air supply chamber that is wedge-shaped in its horizontal section proceeding from an air supply channel in upward and/or downward direction. The latter is known per se, for example, from U.S. Pat. No. 3,999,910.

In comparison with the prior art, the configuration of the spinning machine of the present invention has in particular the advantage that both sides of the spin beam or spinning machine may be operated separately from one another, for example, with different throughputs. They may even be operated or shut down independently, should special operating conditions so require or make this appear to be useful.

BRIEF DESCRIPTION OF THE DRAWINGS

In the following, embodiments of the invention are described with reference to the drawing, in which

FIG. 2 is a longitudinal sectioned view of a spinning machine; and

FIG. 3 is a sectioned bottom view of a spinning machine.

DETAILED DESCRIPTION OF THE PREFERRED EMBODIMENTS

Figure 1:
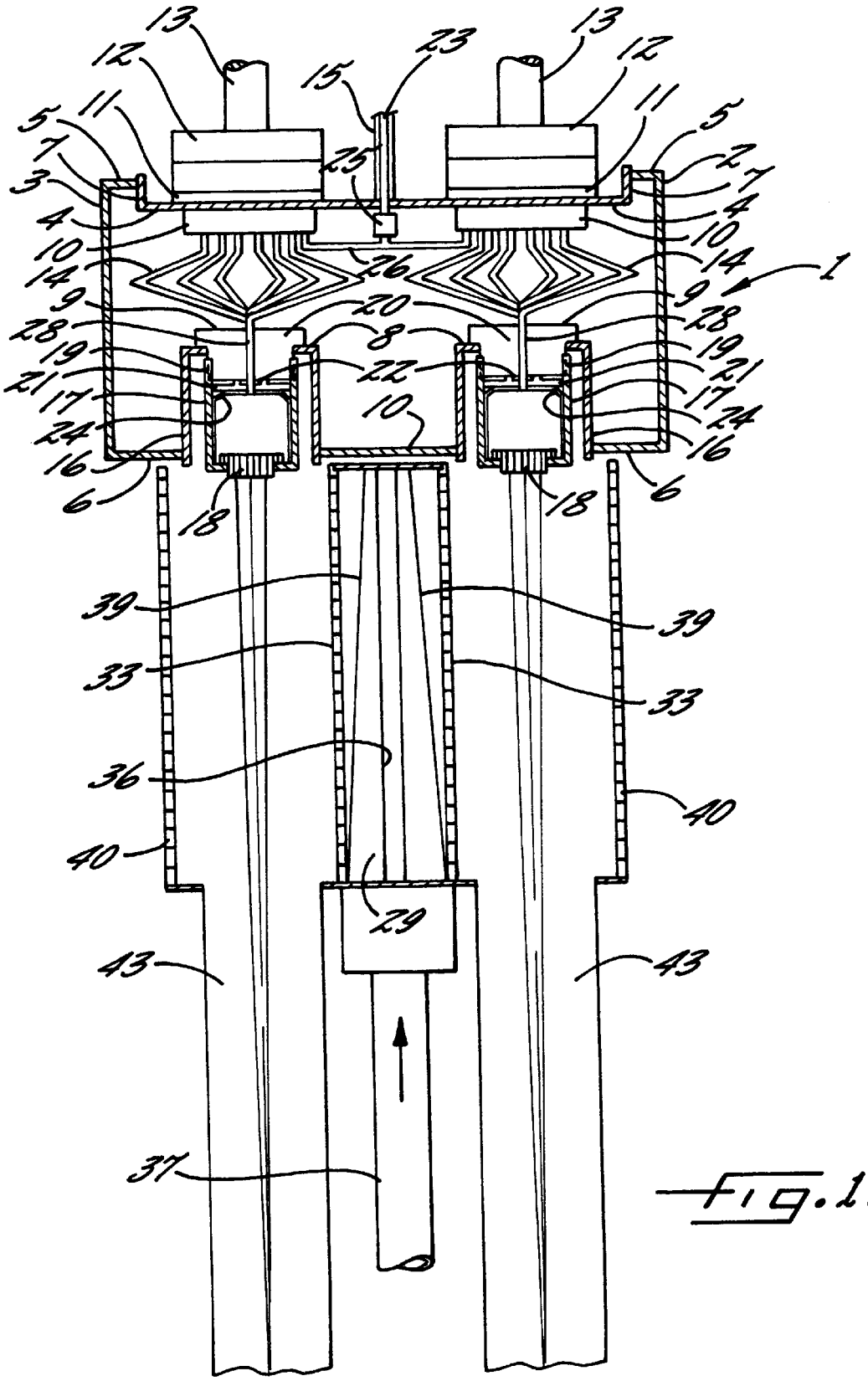
FIG. 1 is a cross sectional view of a spinning machine.

A spin beam 1 is formed by two side plates 2 and 3, as well as an upper plate 4, and lower plates 8. The lateral plates 2 and 3 are U-shaped in their profile. Their horizontally extending transverse walls 5 and 6 form respectively a portion of the upper side and the underside of spin beam 1. The upper plate 4 has likewise a U-shaped cross sectional profile. It extends over the entire length of spin beam 1, and contains over its length at least two holes in its base plate, which serve each to receive and to weld thereto a pump connection plate 11, as described further below. The upper plate 4 comprises side walls 7 which are joined each by welding to the transverse walls 5 of lateral plates 2 and 3. The U-shaped opening of the profile is directed upward. The upward directed base surface of the profile mounts a multiple pump 12 in pressure-tight manner on each of the pump connection plates 11. Each multiple pump 12 is driven by a pump shaft (drive shaft) 13. The multiple pump 12 is a gear pump, which receives a melt flow from a melt line 23. In the pump, the melt flow is distributed over several pump chambers, and subsequently distributed to several distribution lines 14. The melt line 23 is heated by a heating jacket 15, and it connects the melt source (for example, an extruder not shown) with spin beam 1.

The melt feed line 23 leading into spin beam 1 extends through the base side of upper plate 4, and connects then to a distributor 25. From distributor 25, the melt is distributed over distributor lines 26, each of which leads to a pump connection plate 11 of each of pumps 12. In the embodiment comprising a total of twelve spinnerets 18, two pump connection plates 11 and two multiple pumps 12 are provided. Each pump connection plate 11 is located in the center above six spinnerets 18. The melt flow is supplied through melt distribution line 26 to multiple pumps 12. Thereafter, each pump 12 distributes the melt to six distribution lines 14. Each distribution line 14 leads to one spinneret 18, in that it terminates, via a channel 28, in a spin pot 17.

It should be emphasized that the spin pots 17 are of identical construction. They may be rectangular in their horizontal section.

The embodiment includes two lower plates 8 having a U-shaped cross sectional profile. The side walls 16 of these lower plates are directed downward and are welded with their lower end to transverse walls 6 of lateral plates 2, 3. The spacing between lower plates 8 is closed by plate 10. The base surface of each lower plate 8 is provided with several openings, for example six, which are equally spaced from one another. Inserted into these openings and welded to lower plate 8 are connection plates 9. Each of the connection plates 9 extends with a connection member 20 into the U-shaped opening of lower plate 8. On its circumference, the connection member 20 is provided with a screw thread 19. This screw thread serves to join the spin pot 17, which has a corresponding screw thread on its inner circumference. Inserted into the bottom of spin pot 17 is spinneret 18. The spin pot 17 accommodates a piston 21 for displacement therein. This piston 21 is sealed by means of a gasket 22, which surrounds supply line 28, against the lower connecting member 20 of connection plate 9. On its side facing the spinneret 18, the piston 21 is sealed by a diaphragm 24. The melt line 28 extends through piston 21 and diaphragm 24 in the center thereof. In a pressureless state, the diaphragm 24 rests under a slight biasing force against piston 21, and pushes it by means of gasket 22 against the lower front side of connection member 20 of connection plate 9. As a result of the pressure of the melt entering into the spin pot 17, the diaphragm 24 comes to lie against piston 21 and the gap, which surrounds same, and thereby seals the piston 21. At the same time, the piston and gasket 22 are pressed under the necessary sealing force against connection member 20 of connection plate 9. Thus, the spin pack accommodated in spin pot 17 is preferably self-sealing.

As shown in FIG. 1 and the bottom view of FIG. 3, the spin beam 1 is provided with two rows of spinnerets 181, 182, each row consisting of six spinnerets 18. The rows of spinnerets are arranged with a narrow spacing therebetween. Each row of spinnerets 181, 182 is associated to one pump 12. The pump 12 is located approximately in the center above each row (note FIG. 2). The two pumps are supplied, in particular, through common melt feed line 23. In each pump 12, the melt flow is distributed to six distribution lines 14. The distribution lines have the same length and, therefore, they must be detoured to a greater or lesser extent. The spacing between the two rows of spinnerets is selected such that the distribution lines 14 do not obstruct one another.

The melt feed line 23 is supplied by an extruder not shown.

The spin beam 1 itself is supplied with a heating medium, for example, diphenyl vapor.

The spin beam 1 is designed to spin a total of twelve yarns, each yarn consisting of a plurality of filaments.

For cooling the filaments, a cooling device 29 is arranged below spin beam 1, namely in the spacing between the two rows of spinnerets 181, 182. The cooling device is a flat, vertically extending, rectangular solid, which extends along the rows of nozzles. The cooling device is diagonally divided by a vertically extending partition wall 30, thus forming two air distribution chambers 31 and 32. A front wall 33 of each air distribution chamber 31, 32, which faces each of the rows of spinnerets 181, 182 or the filaments emerging therefrom, is made air-permeable and, thus, also known as diffuser wall 33. Located adjacent the narrow end sides of air distribution chambers 31, 32 are air supply chambers 34 and 35, which are connected, via an air slot 36 in each end wall 41, to each of air distribution chambers 31 and 32. The air slot 36 extends substantially over the entire height of each air distribution chamber. Each air supply chamber 34, 35 is defined by parallel opposite side walls 39 and a front wall 38, and connects to an air supply channel 37 which terminates in the bottom of each air supply chamber 34, 35. The air supply chamber extends substantially over the entire height of each air distribution chamber such that its cross section constantly decreases, as shown in FIG. 2. This is realized in that the front wall 38 facing away from each air distribution chamber 31, 32 is obliquely arranged, so that each air supply chamber 34, 35 extends upward substantially in the shape of a cone (FIG. 2). Likewise however, but not shown, it is possible to incline side walls 39 adjacent to each air distribution chamber (FIG. 3), so that the air supply chambers 34, 35 narrow conically over their length from the bottom upward, as is indicated in FIG. 1 by thin lines.

In the illustrated embodiment, each air-permeable wall 33 faces an air outflow wall 40, which is also porous. The air outflow wall 40 has the same dimensions as air-permeable wall 33, and is connected therewith by side walls 41 to form a so-called "cooling shaft" 42.

Subjacent the cooling shaft are so-called "drop chutes" 43, which are made tubular. Each yarn is associated to one tube, which is mounted below a corresponding outlet opening 44 for each yarn.

For cooling the filaments or yarns, the air supply channels 37 are supplied with cooling air by means of a blower not shown. The air flows into air supply chambers 34, 35 and, via air inlet slot 36, into the two distribution chambers 31 and 32, which are divided by diagonal partition wall 30. As a result of the conical configuration of each air supply chamber 34 and 35, it is accomplished that inside these chambers, the air exhibits a uniform pressure distribution. As a result of the diagonal separation of air distribution chambers 31 and 32, each of which converges in wedge shape in direction away from its respective air inlet 36, it is also accomplished that identical pressure conditions form therein, thus ensuring a uniform air flow over the entire width of each distribution chamber.

It should be noted that both air supply channels 37 may also be supplied with cooling air from separate blowers, which are adjustable independently of one another with respect to throughput and amount of pressure.

It should further be noted that the emerging filament yarns are subsequently wound on packages. The packages may be clamped on a winding spindle of one or two takeups. Since the yarns are spun from a single spin beam and cooled under uniform conditions, it is ensured that this large number of filament yarns has also identical properties from yarn to yarn.

We claim:

1. An apparatus for spinning a plurality of synthetic filament yarns, comprising a spin beam in the form of an elongate rectangular enclosure which includes a top wall and a bottom wall, and with said bottom wall having a plurality of connections therein which extend along two parallel side by side rows, a spin pot received in each of said connections, with each spin pot including a spinneret at the underside thereof, a pair of pumps mounted adjacent said top wall of said beam, with each of said pumps having multiple outlets and with one of said pumps being located generally above one of said rows of connections, and the other of said pumps being located generally above the other of said rows, a plurality of distribution lines extending from respective outlets of each of said pumps through said spin beam and to respective ones of the spin pots of its associated row of connections, and an air distribution enclosure positioned below said spin beam and between said rows of connections, said air distribution enclosure being of rectangular outline when viewed in horizontal cross section so as to define two outer side walls which extend parallel to the rows of connections and downwardly from the spin beam, with said outer side walls being air permeable so that cooling air introduced into the air distribution enclosure passes through said outer side walls and transversely across the filaments being extruded through said spinnerets, and wherein said air distribution enclosure further includes an internal partition extending generally parallel to said two outer side walls and dividing the air distribution enclosure into two separate air distribution chambers.

2. The apparatus as defined in claim 1 further comprising a separate air supply chamber connected to each of said air distribution chambers.

3. The apparatus as defined in claim 2 further comprising means for separately controlling the volume air flow rate delivered by each of said air supply chambers.

4. The apparatus as defined in claim 2 wherein said air distribution enclosure further includes two opposite end walls, and wherein said internal partition is disposed along a line extending generally diagonally between said opposite end walls of said enclosure, and wherein each of said air distribution chambers is defined by one of said end walls, one of said outer side walls, and said partition.

5. The apparatus as defined in claim 4 wherein each air distribution chamber includes an inlet in the associated end wall, and wherein the internal partition is positioned such that the horizontal cross section of each air distribution chamber narrows from said inlet toward the opposite end wall.

6. The apparatus as defined in claim 2 wherein each air distribution chamber includes an inlet positioned between the air distribution chamber and the associated air supply chamber, with the inlet extending substantially over the entire height of the air distribution chamber and so as to define a bottom edge and a top edge.

7. The apparatus as defined in claim 6 wherein each air supply chamber has a diminishing cross sectional area from the bottom edge to the top edge of the associated inlet.

8. The apparatus as defined in claim 1 further comprising means for supplying a heating medium into the interior of said enclosure of said spin beam.

9. The apparatus as defined in claim 8 further comprising a melt supply line extending into the interior of said enclosure of said spin beam and then to each of said pumps.

10. An apparatus for spinning a plurality of synthetic filament yarns comprising a spin beam including two parallel side by side rows of spinnerets for spinning two parallel rows of filament bundles which advance downwardly from the spinnerets, and an air distribution enclosure disposed below said spin beam and between said two rows of downwardly advancing filament bundles, said air distribution enclosure being of rectangular outline when viewed in horizontal cross section so as to define two outer side walls which extend parallel to and adjacent respective ones of the rows of downwardly advancing filament bundles, with said two outer side walls being air permeable so that cooling air introduced into the enclosure passes through said outer side walls and transversely across the rows of filament bundles, said air distribution enclosure further including an internal partition extending generally parallel to said two outer side walls and dividing the enclosure into two separate air distribution chambers.

11. The apparatus as defined in claim 10 further comprising a separate air supply chamber connected to each of said air distribution chambers.

12. The apparatus as defined in claim 11 wherein said air distribution enclosure further includes two opposite end walls, and wherein said internal partition is disposed along a line extending generally diagonally between said opposite end walls of said enclosure, and wherein each of said air distribution chambers is defined by one of said end walls, one of said outer side walls, and said partition.

13. The apparatus as defined in claim 12 wherein each air supply chamber includes an inlet in the end wall of its associated air distribution chamber, and such that the horizontal cross section of each air distribution chamber narrows from said inlet toward the opposite end wall.

* * * * *